United States Patent [19]

Hayashi et al.

[11] 3,995,455

[45] Dec. 7, 1976

[54] NEEDLE WRAPPING DEVICE

[75] Inventors: Teishichi Hayashi, Aichi; Yoshiyasu Sakata, Hamamatsu, both of Japan

[73] Assignee: Sakurai Limited, Shizuoko, Japan

[22] Filed: June 5, 1975

[21] Appl. No.: 584,165

[30] Foreign Application Priority Data

June 24, 1974 Japan ..... 49-71989
June 24, 1974 Japan ..... 49-37979[U]

[52] U.S. Cl. ..... 66/135
[51] Int. Cl.[2] ..... D04B 9/32
[58] Field of Search ..... 66/135, 81, 192, 86 E, 66/85 A, 193

[56] References Cited

UNITED STATES PATENTS

| | | | |
|---|---|---|---|
| 2,104,232 | 1/1938 | Lawson | 66/135 |
| 2,204,417 | 6/1940 | Lawson | 66/135 |
| 2,297,440 | 9/1942 | Szucs | 66/85 A |
| 2,974,505 | 3/1961 | Levin | 66/135 X |
| 3,530,688 | 9/1970 | Lombardi | 66/135 |

FOREIGN PATENTS OR APPLICATIONS

| | | | |
|---|---|---|---|
| 450,156 | 7/1936 | United Kingdom | 66/135 |

*Primary Examiner*—Mervin Stein
*Assistant Examiner*—A. M. Falik
*Attorney, Agent, or Firm*—Holman & Stern

[57] ABSTRACT

A pattern-yarn feed device in a knitting machine in which a needle-cylinder has a plurality of circumferentially-spaced, vertical slots in its periphery and receives vertically-slidable needles; a rotary cylinder above the needle-cylinder and a guide cylinder surrounding and secured by the rotary cylinder and having circumferentially-spaced vertical slots; a cam member surrounding and opposing the guide cylinder and including rest and pattern-yarn-feed cams; a vertical-guide piece received in each slot in the guide cylinder and engaging the cam member for vertical reciprocation as the guide cylinder rotates, the guide-piece having a guide slot at its lower end; a twisted rod unit guided in the guide slot in the guide-piece and rotatable as the guide-piece rotates; and a horizontal guide arm secured to the lower end of the twisted rod unit and having a pattern-yarn-guide hole rotatable as the twisted rod unit rotates and a pattern-yarn is guided through said guide hole in the guide arm into one or more knitting needles and form a pattern on a ground weave.

3 Claims, 13 Drawing Figures

Fig. 5-e.
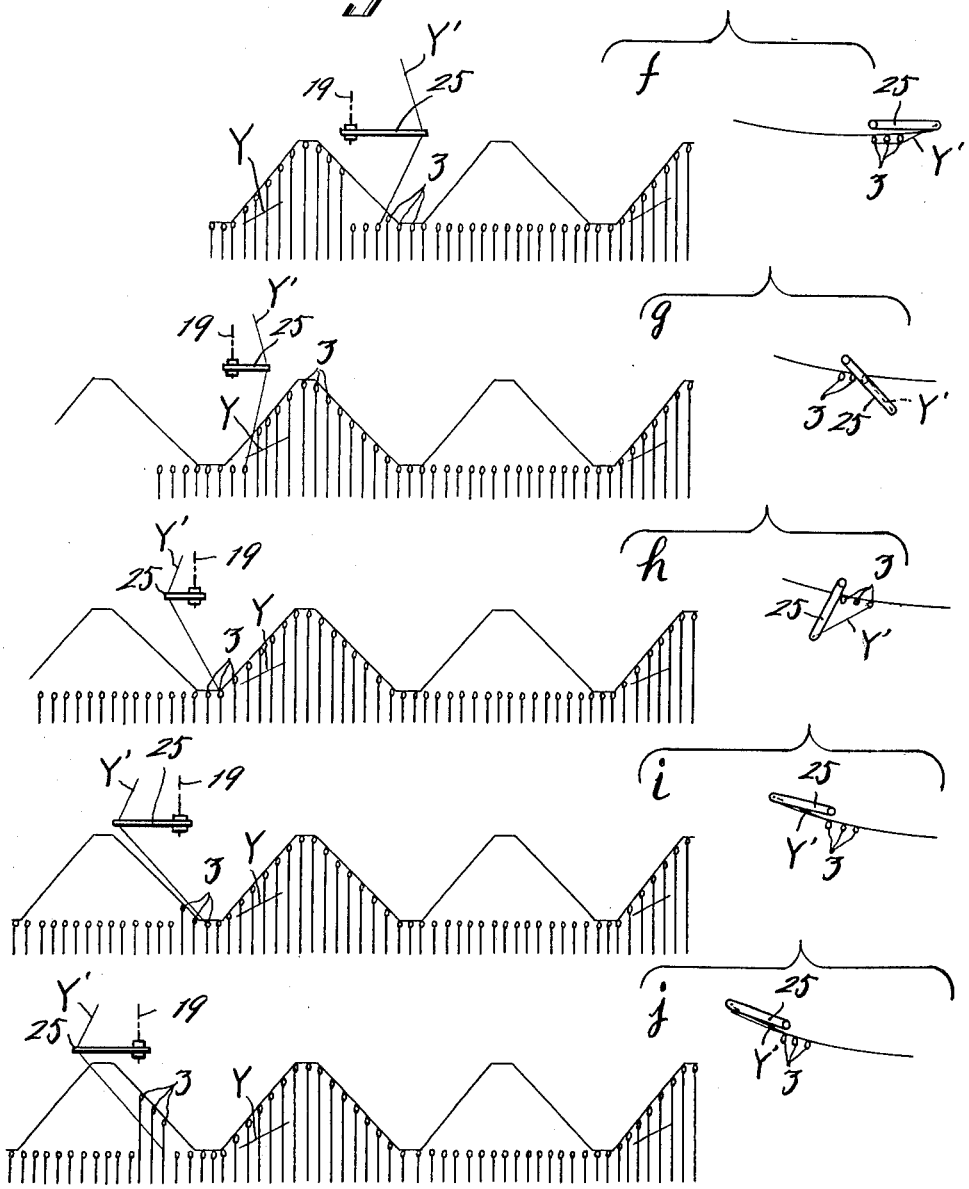

Fig. 9-1.
I
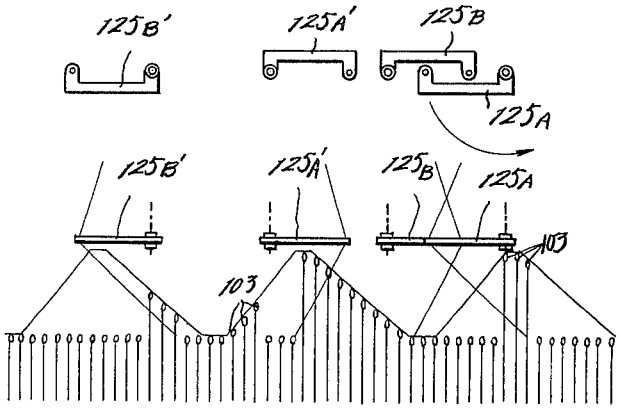
II
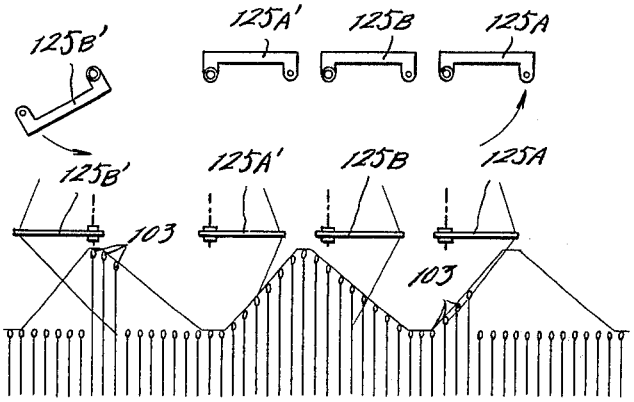
III
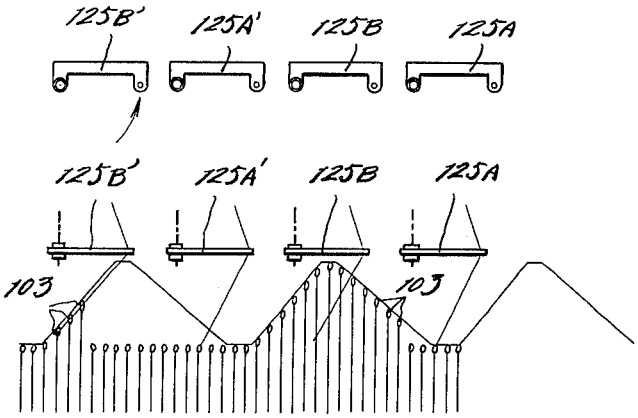

Fig. 9-2.
IV
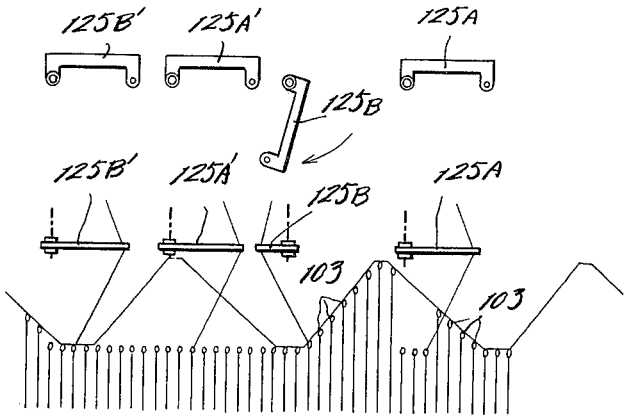
V
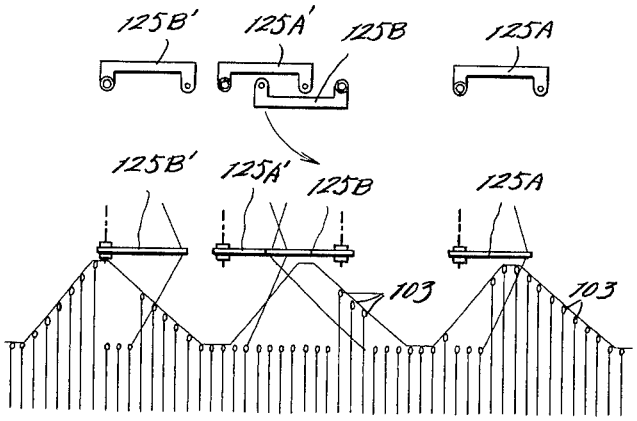
VI
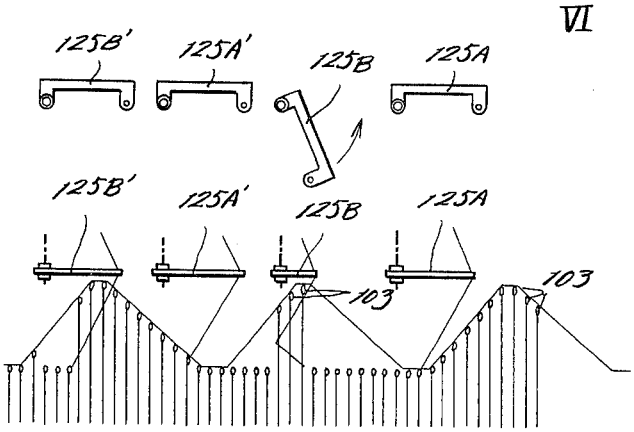

Fig. 9-3.
VII
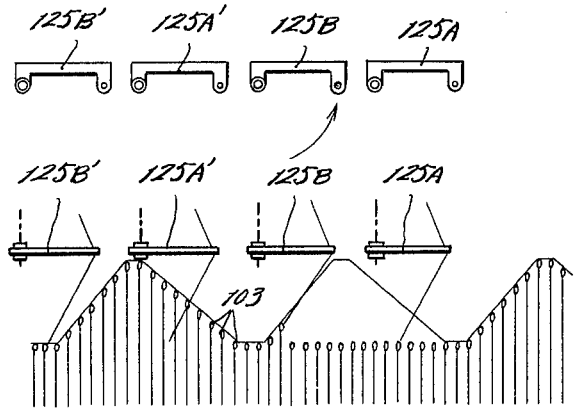
VIII
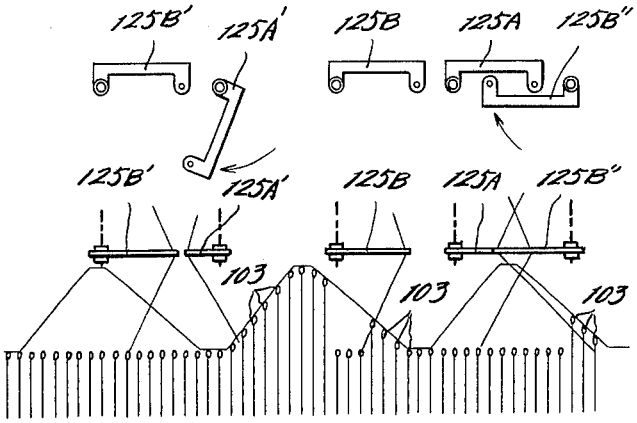
IX
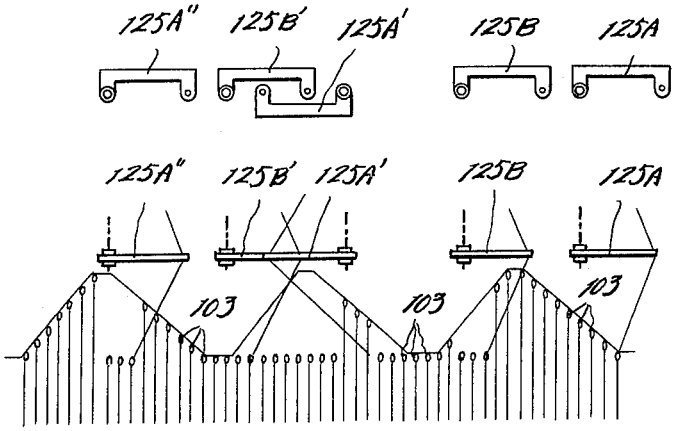

Fig. 9-a.
X
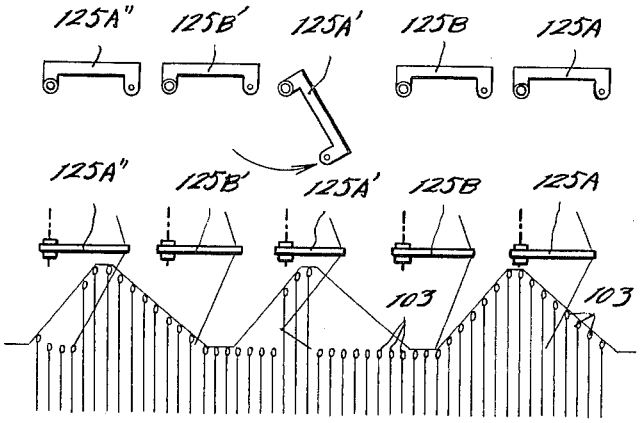
XI
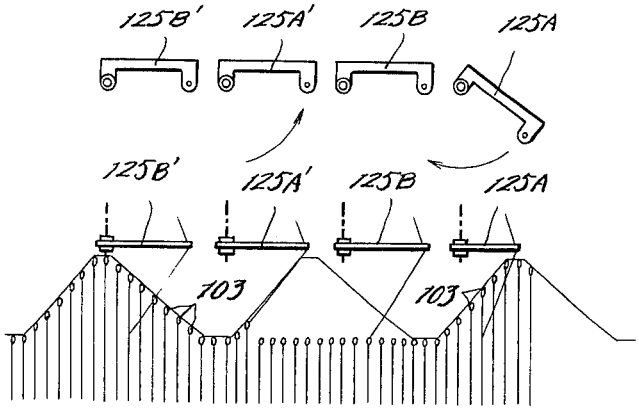
XII
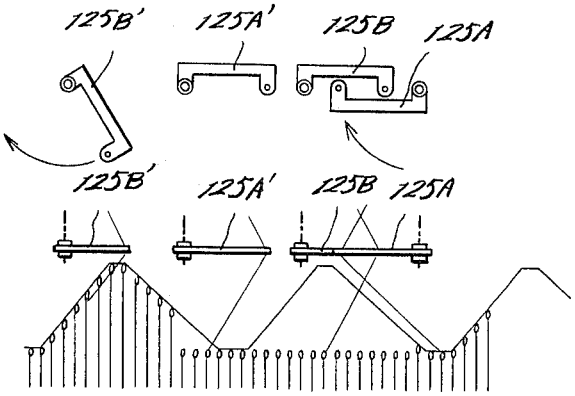

NEEDLE WRAPPING DEVICE

FIELD OF THE INVENTION

This invention relates to a pattern-yarn-feed device in a knitting machine.

BACKGROUND OF THE INVENTION

The improvement more particularly relates to a pattern yarn feed device in a knitting machine in which one or more selected knitting needles of a plurality of knitting needles disposed in a closely spaced relationship are fed with a pattern-yarn so as to form patterns on a ground weave being formed in a closely spaced relationship or without any space therebetween.

SUMMARY OF THE INVENTION

According to the present invention, one cam member or a pair of vertically spaced cam members are provided and as the cam member or cam members are rotated, at least one guide piece, received in each of a plurality of vertical slots in a guide cylinder, opposing the cam or cams is moved upwardly and downwardly which in turn rotates a twisted piece-threaded unit guided in the guide piece and the rotation of the unit rotates a guide arm secured to the threaded rod and having a pattern yarn whereby a pattern yarn is guided through the guide hole in the guide arm into selected knitting needles.

According to the present invention, a pattern yarn feed device is provided in a knitting machine which comprises a needle cylinder rotatably supported on the framework of said feed device and having a plurality of circumferentially spaced vertical slots in which knitting needles are slidingly received for vertical movement, a rotary cylinder rotatably supported on said framework immediately above said needle cylinder, a guide cylinder secured to the outer periphery of said rotary cylinder for rotation therewith and having a plurality of circumferentially spaced vertical slots, at least one cam member surrounding and opposite said guide cylinder and including rest and pattern-yarn feed cams in combination, at least one guide piece is received in each of said vertical slots in the guide cylinder for movement upwardly and downwardly therein as said rotary cylinder rotates and has a guide slot at the lower end, said guide piece further having a notch for engaging said cam member, at least one twisted piece having an upper twisted portion and an integral lower threaded rod extending downwardly from said twisted upper portion for rotation as said guide piece moves upwardly and downwardly, and at least one guide arm is secured to the lower end of said threaded rod for rotation therewith and having a pattern yarn guide hole whereby a pattern yarn is guided through said guide hole in the guide arm into one or more selected knitting needles so as to form a pattern on a ground weave being formed.

These, together with other objects and advantages of the invention, will become apparent from consideration of the following description of exemplary embodiments when taken in conjunction with the accompanying drawing forming a part thereof in which:

BRIEF DESCRIPTION OF THE DRAWINGS

FIGS. 5-1 and 5-2 are diagrammatic views, showing in sub-views *a–e* and *f–j*, respectively, the progressive relative positions of selected knitting needles 3 in relation to guide arm 25 and threaded rod 19 to introduce the pattern-yarn Y′ showing the relationship between one guide arm and knitting needles;

FIGS. 8-1, 8-2 and 8-3 are perspective views, on an enlarged scale, respectively showing guide pieces and a twisted piece-guide arm assembly employed in the pattern yarn feed device of FIG. 6;

FIGS. 9-1, 9-2, 9-3 and 9-4 are diagrammatic views, showing in subviews I–III, IV–VI, VII–IX, and X–XII, respectively, the operating sequence of guide arms 125 in relation to selected knitting needles 103.

DESCRIPTION OF PREFERRED EMBODIMENTS

Figure 1:
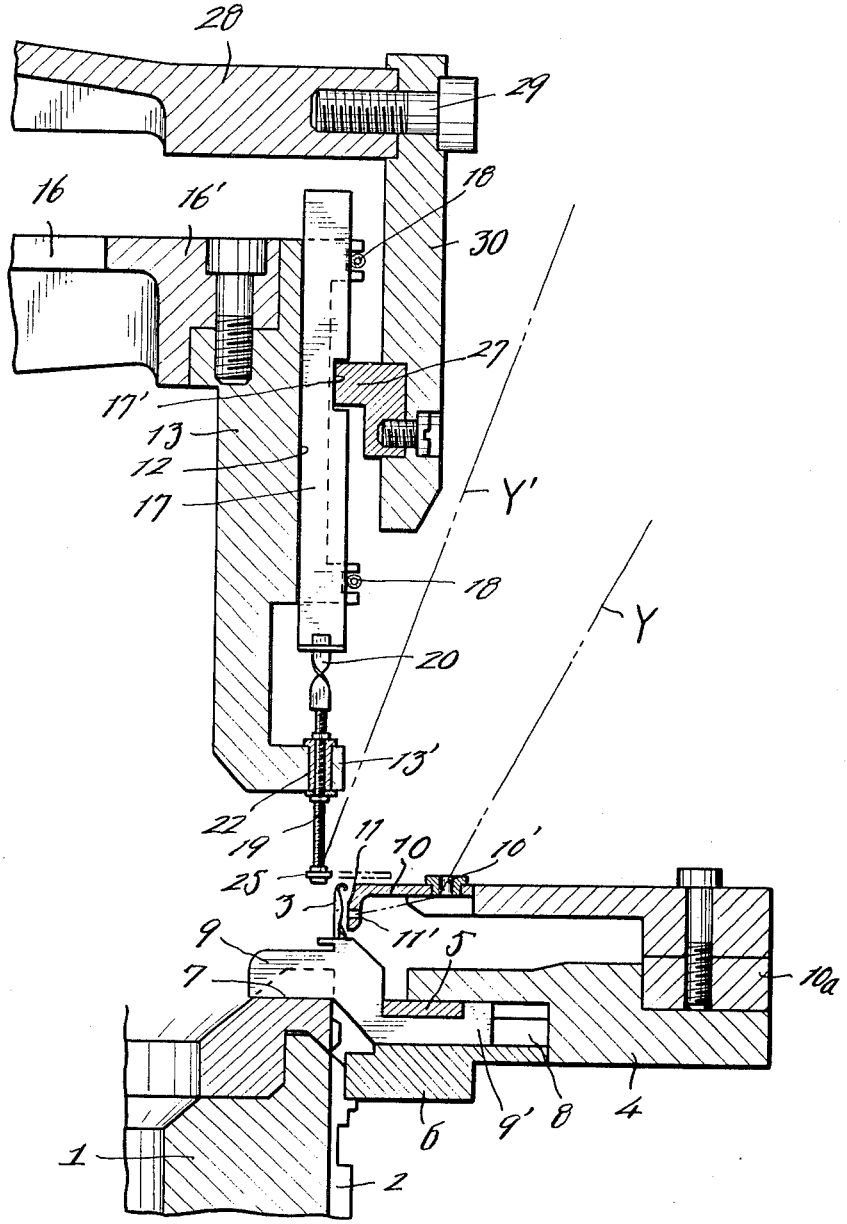
FIG. 1 is a fragmentary vertical sectional view of one preferred embodiment of pattern yarn feed device in a knitting machine constructed in accordance with the present invention.
Figure 2:
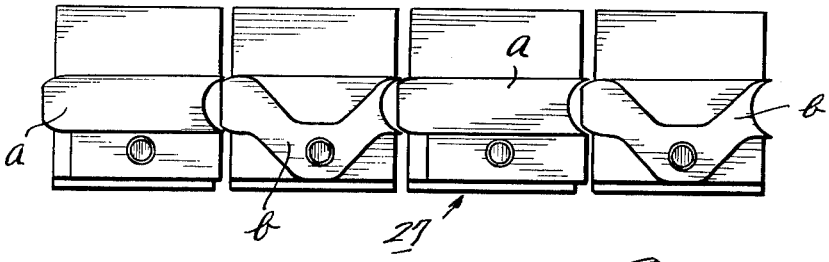
FIG. 2 is an enlarged fragmentary developed view of one cam member including rest and pattern-yarn feed cams in combination of said pattern-yarn feed device.
Figure 3:
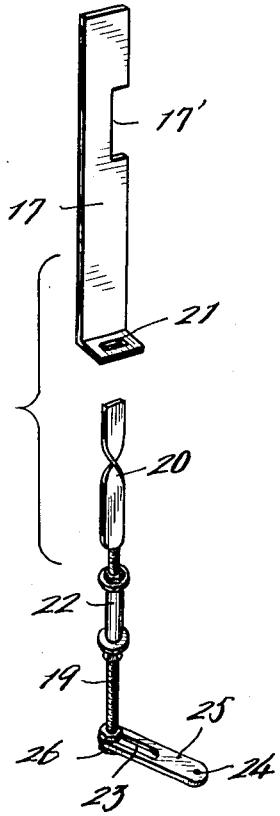
FIG. 3 is an enlarged perspective view of one pattern-yarn guide arm for introducing a pattern yarn into a knitting needle, one twisted piece having an integral threaded rod secured to said guide arm and one guide piece in which said twisted piece is guided.

The present invention will be now described referring to the accompanying drawing and more particularly, to FIGS. 1 through 5 in which a first embodiment of pattern-yarn feed device of the invention is shown. The pattern-yard feed device generally comprises a needle cylinder 1 having a plurality of circumferentially spaced vertical needle receiving slots 2 in its outer periphery and rotatably supported in a framework (not shown) of the pattern yarn feed device. A knitting needle 3 is slidingly received in each of the vertical slots 2 for vertical movement in the manner as will be described hereinafter. The knitting needle 3 is a conventional latch-needle and detailed description of the needle will be omitted herein. A plurality of cams (not shown) are provided in the framework in opposition to the needles 3 about the needle cylinder 1 and each of the cams is adapted to engage the butt of an associated knitting needle 3 so as to move the needle upwardly and downwardly within its associated slot 2.

An annular sinker-cam holder 4 is provided surrounding the upper end portion of the needle cylinder 1 and is fixedly secured to a suitable support (not shown) which is in turn fixedly secured to the framework. The inner periphery of the sinker-cam holder 4 has an annular sinker-cam 5 secured thereto. The sinker-cam 5 projects radially and inwardly toward the needle cylinder 1 beyond the inner periphery of the sinker cam holder 4.

Positioned below the sinker-cam 5 is an annular sinker support 6 which is supported on the outer periphery of the needle cylinder 1 and has the inner periphery engaged in the slots 2. The sinker-cam 5 and annular sinker-support 6 define an annular recess 8 therebetween for receiving the shanks 9' of a plurality of sinkers 9 whose front end portions are received in a plurality of circumferentially spaced slots 7 formed in the top of the needle cylinder 1 so that the sinkers 9 and sinker-support 6 can rotate together with the needle cylinder 1 and needles 3. Thus, as in the conventional pattern-yarn feed devices, the sinkers 9 reciprocally move back and forth as the sinker cam 5 is actuated and form a ground weave in cooperation with selected knitting needles 3. An annular ground-yarn guide plate 10 is fixedly secured to the sinker-cam holder 4 by means of suitable fastening means such as bolts with an annular spacer 10*a* interposed therebetween and provided with a plurality of circumferentially spaced ground-yarn guide holes 10' through which ground-yarns Y are guided. An annular and bent guide piece 11 is fixedly secured to the inner periphery of the ground yarn guide plate 10. The guide piece 11 is also provided with a plurality of circumferentially spaced ground yarn guide holes 11' through which the ground yarns Y from the guide holes 10' are guided into the knitting needles 3 which form the ground weave in a conventional manner.

Positioned immediately above the needle cylinder 1 is a pattern yarn guide cylinder 13 fixedly secured to the annular flange 16' of a rotary cylinder 16 which is in turn journalled in a support arm (not shown) supported on a plurality of pillars (not shown) which are in turn suitably secured to the framework. The pattern-yarn guide cylinder 13 is provided in its periphery with a plurality of circumferentially spaced vertical slots 12 in each of which at least one pattern-yarn guide piece 17 having a notch 17' (in the illustrated embodiment, two pattern-yarn guide pieces are provided) is received for vertical movement. The pattern yarn guide pieces 17 are prevented from leaving out of the associated slot 12 by means of annular holders 18 which are secured to the guide cylinder 13. As more clearly shown in FIG. 3, each guide piece 17 has a substantially L-shape including a vertical upper portion having a notch 17' at one side edge and a horizontal lower portion bent at right angles to the vertical portion and provided with a slot 21. A vertical twisted piece 20 is guided in the slot 21 in the guide piece 17 for rotational movement in one or the other direction with respect to the guide piece 17 as the guide piece 17 moves upwardly and downwardly and has an integral threaded rod 19 extending downwardly therefrom and journalled in a hollow stub shaft 22. A horizontal guide arm 25 is secured at one end to the lower end of threaded rod 19 and extends therefrom at right angles thereto. The guide arm 25 is provided at the other end with a pattern yarn guide hole 24 and a slot 23 between the opposite ends. Thus, the radial position of the guide piece-twisted piece assembly with respect to the guide cylinder can be adjusted within the limit defined by the length of the slot 23 in the guide arm 25. As more clearly shown in FIG. 4, one guide arm 25 is positioned in a height different from that in which the other guide rod 25 is positioned so that when the two guide arms are rotated, they will not interfere with each other. Thus, the space between the two guide piece-twisted piece assemblies 17, 20 will be reduced. A nut 26 is threaded on the extreme end of the threaded rod 19. The above-mentioned hollow stub shaft 22 is mounted in an annular flange 13' provided about the lower end of the guide cylinder 13.

A cam member 27 is positioned about the guide cylinder 13 with the inner periphery fitted in the notches 17' in the guide pieces 17 and includes rest and pattern yarn feed cams *a* and *b* in combination. When the rotary cylinder 16 is rotated, the guide cylinder 13 integrally secured to the rotary cylinder also rotates to move the guide pieces 17 upwardly and downwardly along the cam member 27. The upward and downward movement of the guide pieces 17 rotates the twisted pieces 20 which in turn rotates the guide arms 25 whereby a pattern yarn Y' is introduced into selected knitting needles 3 which are then in the raised position to form a pattern on the ground weave being formed.

The cam member 27 is supported in an annular cam holding plate 30 by means of bolts and the holding plate is adjustably secured to a stationary member 28 by means of bolts 29 which are threaded in the top of the holding plate 30.

In order to pass the pattern yard Y' through the yarn guide holes 24 in the guide arms 25, the pattern yarn Y' is paid out of a yarn supply bobbin positioned externally of the cam holding plate 30 and passed through a yard hole (not shown) in the rotary cylinder 16 into the guide holes 24 in the guide arms 25.

In operation, when the needle cylinder 1 and annular sinker support 6 are rotated, selected knitting needles 3 are caused to move upwardly and downwardly by the cams (not shown) provided in opposition to the needle cylinder 1 and ground yarns Y are fed to the knitting needles 3 to form a ground weave in the conventional manner. Simultaneously, the rotary cylinder 16 is rotated at the same rate as the needle cylinder 1 and sinker-support 6 to rotate the guide cylinder 13 which in turn moves the guide pieces 17 upwardly and downwardly. When selected knitting needles 3 are in the raised position as shown in FIG. 5*a*, the notch 17' in the guide piece 17 is positioned opposite to and engages one yarn feed cam *b* on the cam member 27 to be raised by the cam *b.* As the guide piece 17 moves upwardly, the rising guide piece rotates the guide arm 25 about the knitting needles 3 by one half of its complete rotation in one direction through the twisted piece 20 and its integral threaded rod 19 (see FIGS. 5*b*, 5*c* and 5*d*) to thereby introduce the pattern-yarn Y' which has passed through the guide hole 24 in the guide arm 25 into the heads of the knitting needles 3. After the pattern-yarn feed cycle has been completed, the guide arm 25 remains stationary by one rest cam *a* on the cam member 27 and waits for the next pattern-yarn feed cycle. Thereafter, while the selected knitting needles 3 are rising, the guide piece 17 moves downwardly by the action of a particular yarn feed cam *b* on the cam member 27 to initiate the rotation of the guide arm 25 in the other direction. By the time the guide piece 17 has moved to its predetermined lowest position, the rotation of the guide arm 25 in the other direction would have been completed (see FIGS. 5*g*, 5*h* and 5*i*) whereupon the pattern-yarn Y' is positioned behind the selected knitting needles 3. With the pattern-yarn Y' held in the above-mentioned position, when the selected needles 3 have reached their predetermined uppermost position, the guide piece 17 rises to rotate the guide arm 25 through the twisted piece-threaded rod unit 20, 19 to thereby introduce the pattern yarn Y' into the heads of the selected knitting needles 3.

Figure 4:
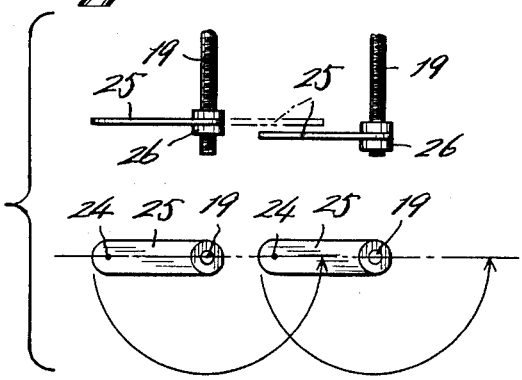
FIG. 4 is a diagrammatic view showing the operation of said guide arms in both elevation and plan.
Figures 1, 5:
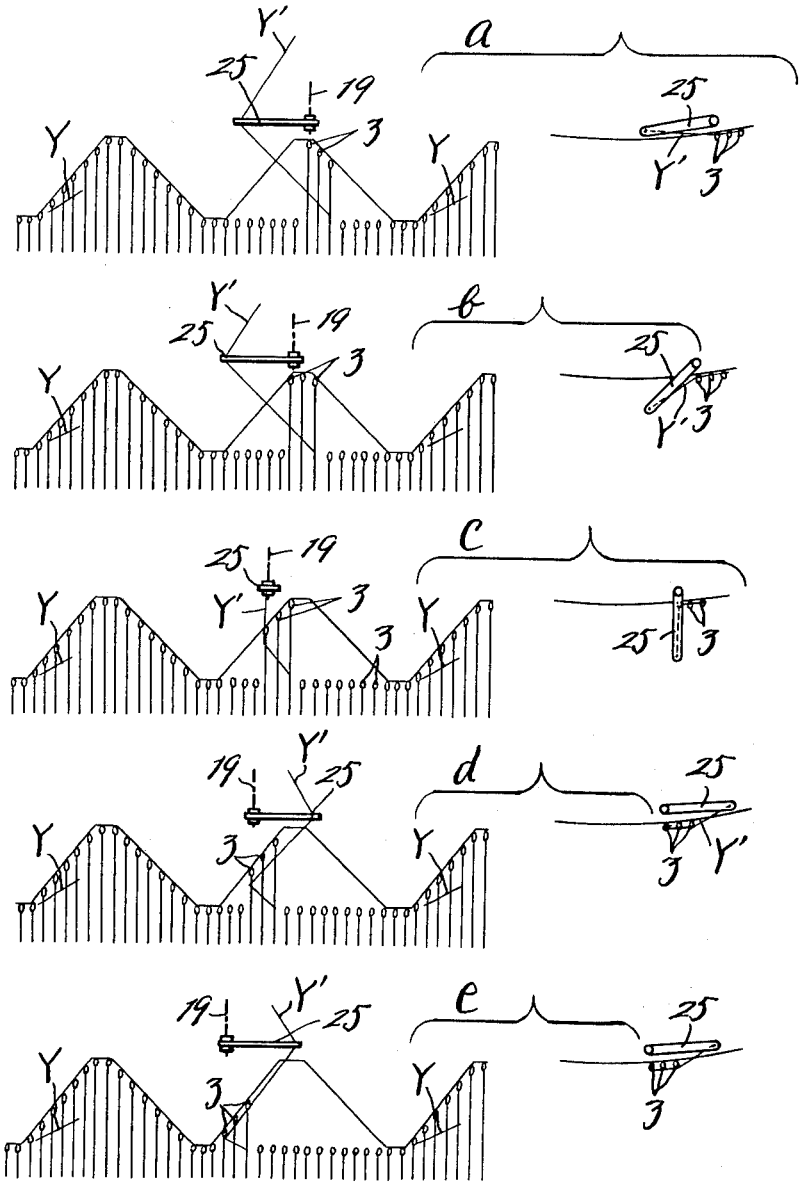
Figure 6:
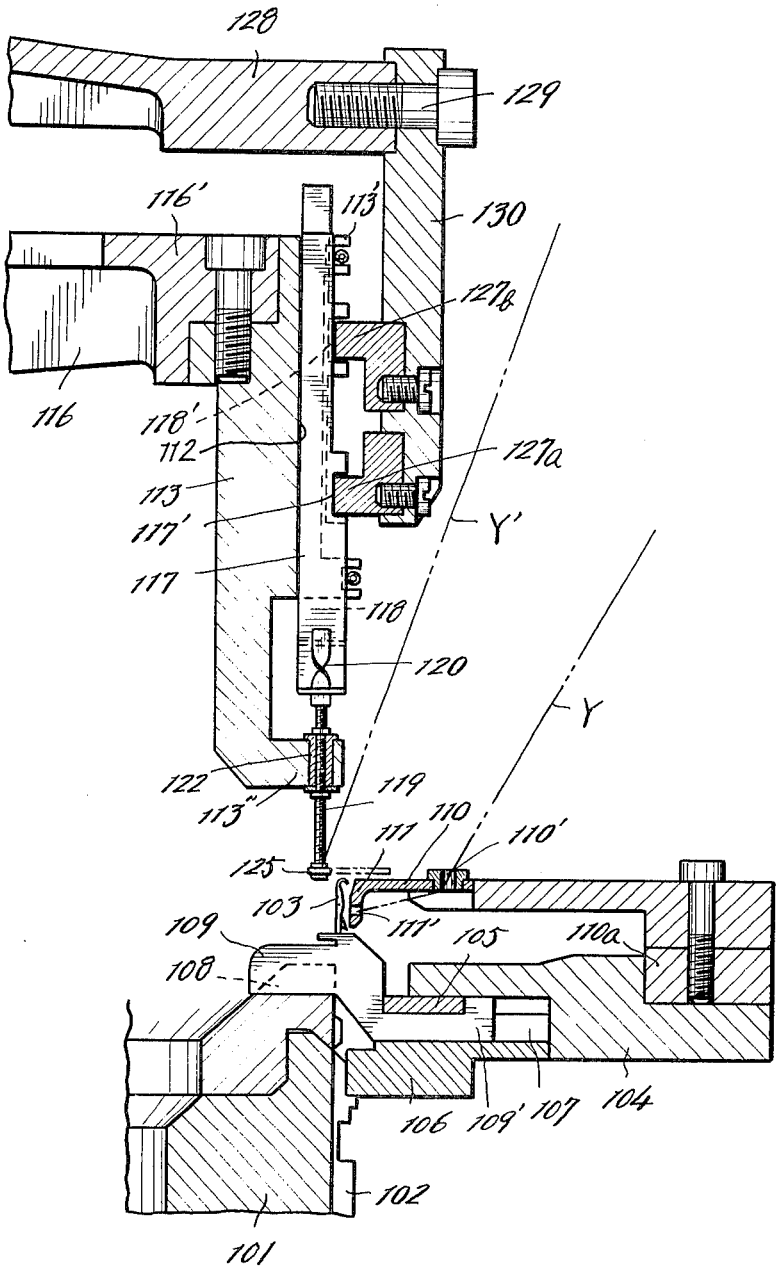
FIG. 6 is a fragmentary vertical sectional view, similar to FIG. 1, of an alternate embodiment of pattern-yarn feed device in a knitting machine constructed in accordance with the present invention and including a dual cam arrangement.
Figure 7:
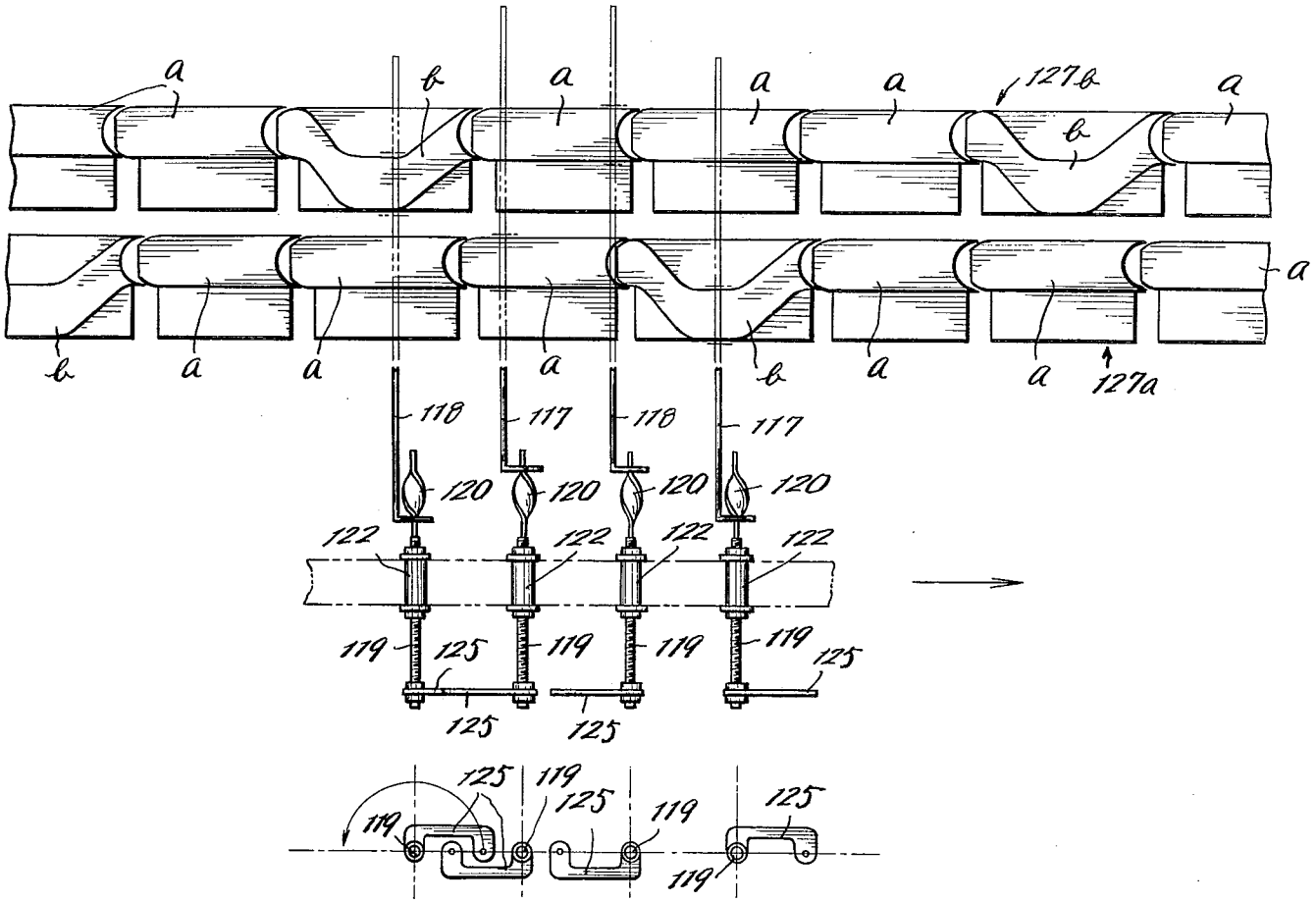
FIG. 7 is a diagrammatic view showing the relationship between the cam members and guide arm-twisted piece-guide piece assemblies of the pattern yarn feed device of FIG. 6 in both elevation and in plan.
Figure 8:
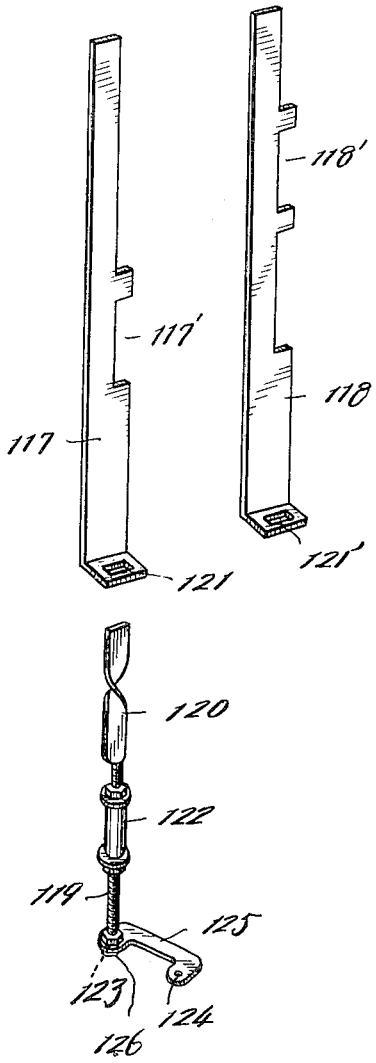

By repeating the above-mentioned procedure, the pattern-yarn Y' forms a predetermined pattern on the ground weave being formed. And, as shown in FIG. 4, since the two guide arms 25 are secured to the associated threaded rods 19 integral with their twisted pieces 20 in different heights in each of the slots 12 in the guide cylinder 13, the distance between the threaded rods 19 can be reduced and the guide arms 25 will not interfere with each other as they rotate to thereby reduce the space between the pattern-yarns Y' in a pattern or between patterns.

Referring now to FIGS. 6 through 9 which show the second embodiment of pattern-yarn feed device in a knitting machine constructed in accordance with the present invention. The second embodiment is substantially similar to the first embodiment as shown in FIGS. 1 through 5 except that two cam members are positioned in different heights in the same vertical plane. The second embodiment will be now described in detail referring to FIGS. 6 through 9.

The second embodiment of pattern-yarn feed device generally comprises a needle cylinder 101 rotatably supported on the framework (not shown) of the device and having a plurality of circumferentially spaced vertical slots 102, in its outer periphery. In each of the vertical slots 102, a latch knitting needle 102 is slidingly received for movement upwardly and downwardly therein. The knitting needles 103 are engaged at their butts by associated needle operation cams (not shown) positioned in opposition to the needle cylinder 101 to be moved upwardly and downwardly.

An annular sinker-cam holder 104 is provided surrounding the upper end portion of the needle cylinder 101 and fixedly secured to a suitable support (not shown) which is in turn fixedly secured to the framework. The inner periphery of the sinker-cam holder 104 has an annular sinker-cam 105 secured thereto. The sinker-cam 105 projects radially and inwardly toward the needle cylinder 101 beyond the inner periphery of the sinker-cam holder 104.

Positioned below the sinker-cam 105 is an annular sinker support 106 which is supported on the outer periphery of the needle cylinder 101 and has the inner periphery engaged in the slots 102 in the needle cylinder 101. The sinker-cam 105 and annular sinker-cam 106 define an annular recess 107 therebetween for receiving the shanks 109' of a plurality of sinkers 109 whose front end portions are received in a plurality of circumferentially spaced slots 108 formed in the top of the needle cylinder 101 so that the sinkers 109 and sinker-support 106 can rotate together with the needle cylinder 101 and needles 103. Thus, as in the conventional pattern-yarn feed devices, the sinkers 109 reciprocally move back and forth as the sinker cam 105 is actuated and form a ground weave in cooperation with selected knitting needles 103.

An annular ground yarn guide plate 110 is fixedly secured to the sinker-cam holder 104 by means of suitable fastening means such as bolts with an annular spacer 110*a* interposed therebetween and provided with a plurality of circumferentially spaced ground yarn guide holes 110' through which ground yarns Y are guided. An annular and bent guide piece 111 is fixedly secured to the inner periphery of the ground yarn guide plate 110. The guide piece 111 is also provided with a plurality of circumferentially spaced ground yarns guide holes 111' through which ground yarns Y from the guide holes 110' are guided into the heads of the knitting needles 3 which are forming the ground weave in the conventional manner.

Positioned immediately above the needle cylinder 101 is a pattern yarn guide cylinder 113 fixedly secured to the annular flange 116' of a rotary cylinder 116 which is in turn journalled in a support art (not shown) supported on a plurality of pillars (not shown) which are in turn suitably secured to the framework. The pattern-yarn guide cylinder 113 is provided in its outer perphery with a plurality of circumferentially spaced vertical slots 112 in each of which a pair of juxtaposed guide pieces 117 and 118 having notches 117' and 118' in different heights, respectively, are received for movement upwardly and downwardly and the guide pieces are prevented from coming out of the associated slots 112 by means of annular holding means 113' which are provided about the guide cylinder 113.

Each of the guide pieces 117 and 118 has a substantially L-shape including a vertical upper portion having the notch 117' or 118' and a horizontal lower portion extending from the upper portion at right angles thereto and having a guide slot 121 or 121'. A flat twisted piece 120 is guided in each of the slots 121 and 121' of the guide pieces 117 and 118 and has an integral threaded rod 119 extending downwardly from the twisted piece. The twisted pieces 120 are adapted to rotate in or the other direction as the associated guide pieces 117 and 118 move upwardly and downwardly.

Each of the threaded rods 119 is journalled in a hollow stub shaft 122 and a horizontal guide arm 125 is secured at one end to the lower end of the threaded rod 119 and extends therefrom at right angles thereto. The guide arm 125 has a pattern yarn guide hole 124 at the other end and a slot 123 between the opposite ends thereof. A nut 126 is threaded on the extreme end of the threaded rod 119. The hollow stub shafts 122 are mounted in an annular flange 113'' formed about the lower end of the guide cylinder 113.

A pair of cam members 127*a* and 127*b* are provided in a vertically spaced relationship in the same vertical plane surrounding the guide cylinder 113 with the inner periphery of the cam members fitted in the notches 117' and 118' in the guide pieces 117 and 118, respectively. Each of the cam members 127*a* and 127*b* includes rest cams *a* and pattern yarn feed cams *b* in combination. Thus, when the rotary cylinder 116 is rotated, the guide cylinder 113 integrally connected to the rotary cylinder 116 also rotates. As the guide cylinder 113 rotates, the guide pieces 117 and 118 are moved upwardly and downwardly along the cam members 127*a* and 127*b* to rotate the associated twisted pieces 120 and threaded rods 119 which in turn rotate the guide arms 125 to thereby introduce the pattern yarn Y' into the heads of the selected knitting needles 103 in the raised position to form a pattern on the ground weave being formed.

As mentioned hereinabove in connection with the first embodiment, the cam members 127*a* and 127*b* are secured to an annular cam holding plate 130 which is adjustably secured to an annular holding member 128 by means of bolts 129.

In order to guide the pattern yarn Y' to and through the guide hole 124 in each of the guide arm 125, the pattern yarn Y' is paid out of a supply bobbin (not shown) positioned externally of the cam holding plate 130 and guided to and through the guide hole 124.

In operation, the needle cylinder 101 and sinker-support 106 are rotated to move the knitting needles 103 upwardly and downwardly and at the same time, ground yarns Y are fed to the knitting machine to form a ground weave in the conventional manner. Simultaneously, the rotary cylinder 116 is rotated at the same rate as the needle cylinder 101 and sinker support 106 to rotate the guide cylinder 113. The rotation of the guide cylinder 113 moves the guide pieces 117 and 118 upwardly and downwardly. When a yarn feed cam *b* of the cam members 127*a* or 127*b* acts, the guide piece 117 or 118 moves downwardly just before the selected knitting needles 103 rise while the guide cylinder 113 is rotating. As the guide piece 117 or 118 moves downwardly, the twisted piece-threaded rod unit 120, 119 associated with the downwardly moving guide piece rotates the associated guide arm 125. In such a case, the guide arm 125 rotates about a half of one complete rotation in the other direction carrying the pattern-yarn Y′ therewith. At this time, the pattern-yarn Y′ is positioned behind the selected knitting needles 103.

Thereafter, the guide piece 117 or 118 rises to rotate the guide arm 125 carrying the pattern-yarn Y′ therewith in one direction. While the guide arm 125 is rotating, the pattern-yarn Y′ is introduced into the heads of the selected knitting needles 103 in the raised position. After the pattern-yarn Y′ has been perfectly fed, the guide piece 117 or 118 is held stationary by a rest cam *a* of the cam member and waits until a yarn feed cam *b* of the cam member 127*a* or 127*b* acts again. By repeating the above procedure, a pattern is formed of the ground weave being formed.

Referring now to FIG. 9, the operation sequence of the guide arms 125A and 125B, to be actuated by the cam member 127*a*, and of the guide arms 125B, to be actuated by the cam member 127*b*, will be described. In FIG. 9, I shows the stage in which the guide arm 125A initiates the rotation in one direction, the guide arms 125B and 125A′ are held in the waiting position by rest cams *a* of the cam members and the guide arm 125B′ engages a pattern yarn feed cam *b* of the cam member and is ready for the rotation in the one direction.

II shows the stage in which the guide arm 12A is in its raised position and has completed its rotation in the one direction by a pattern yarn cam *b*, the guide arms 125B and 125A′ are awaiting for rotation by rest cams *a* and the guide arm 125B′ is rotating in the one direction by a yarn feed cam *b*.

III shows the stage in which the guide arms 125A, 125B and 125B′ are held in the rest position by rest cams *a* and the guide arm 125B′ has completed the rotation in the one direction.

IV shows the stage in which the guide arms 125A, 125A′ and 125B′ are held in the ready position by rest cams and the guide arm 125B is descending and rotating in the other direction.

V shows the stage in which the guide arms 125A, 125A′ and 125B′ are held in the rest position by rest cams and the guide arm 125B is about to engage a yarn feed cam *b* or waiting for rotation in the one direction.

VI shows the stage in which the guide arms 125A, 125A′ and 125B′ are held in the waiting position by rest cams *a* and the guide arm 125B is rotating in the one direction.

VII shows the stage in which the guide pieces 125A, 125A′ and 125B′ are held in the waiting position by rest cams *a* and the guide arm 125B has completed the rotation in the one direction by a yarn feed cam *b*.

VIII shows the stage in which the guide arms 125A, 125B and 125B′ are held in the waiting position by rest cams *a*, the guide arm 125A′ is descending and rotating in the other direction along a yarn feed cam *b* and the guide arm 125A and its adjacent guide arm 125B″ have completed the rotation in the other direction.

IX shows the stage in which the guide arms 125A, 125B and 125B′ are held in the rest position by rest cams *a* and the guide arm 125A′ is about to rise and rotate in the one direction.

X shows the stage in which the guide cams 125A, 125B and 125B′ are held in the rest position by rest cams *a* and the guide arm 125A′ is rotating in the one direction.

XI shows the stage in which the guide arm 125A has shifted from a yarn feed cam *b* to a rest cam *a* and is ready to descend and initiate the rotation in the one direction, the guide arm 125A′ has completed the rotation in the one direction by a yarn feed cam *b* and the guide arms 125B and 125B′ are held in the rest position by rest cams *a*.

XII shows the stage in which the guide arm 125A has completed the rotation in the other direction and held in the rest position by a rest cam *a*, the guide arms 125B and 125A′ are held in the rest position by rest cams *b* and the guide arm 125B′ is rotating in the other direction by a yarn feed cam *b*.

As mentioned hereinabove, according to the present invention, one or two vertically spaced cam members each having rest and yarn feed cams *a* and *b* in combination are provided, the guide pieces received in the guide cylinder integral with the rotary cylinder engage the cam member or members to be moved upwardly and downwardly by the cam member or members, the upward and downward movement of the guide pieces rotates the twisted pieces guided in the slots in the guide pieces and having the integral threaded rods and guide arms secured to the threaded rods and having yarn guide holes are rotated by the rotating twisted piece-threaded rod units to thereby guide pattern-yarns through the guide holes into the heads of selected knitting needles so as to form a pattern on a ground weave being formed. As mentioned hereinabove, by moving the guide arms upwardly and downwardly by the upwardly and downwardly moving guide pieces and providing the cam members in a vertically spaced relationship, when one of the guide arms is rotated by one of the cam members, the other guide piece is held in operative by the other cam member and thus, the the space between the threaded rods can be reduced to thereby reduce the space between the pattern-yarns in a pattern and/or between patterns. Furthermore, according to the present invention, pattern-yarns can be positively fed to selected knitting needles and the pattern-yarn feed device is quite simple in construction and operation.

In the foregoing, description has been made of two preferred embodiments, but it will readily occur to those skilled in the art that the same are illustrative in nature, but do not limit the scope of the invention in any way. The scope of the invention is only limited by the appended claims.

What is claimed is:

1. A pattern-yarn feed device in a knitting machine comprising a needle cylinder for rotatable support on the framework of a feed device, said needle cylinder having a plurality of circumferentially spaced vertical slots in which knitting needles are slidingly received for vertical movement, a rotary cylinder rotatably supported on said framework immediately above said needle cylinder, a guide cylinder secured to the outer periphery of said rotary cylinder for rotation therewith and having a plurality of circumferentially spaced vertical slots, at least one cam member surrounding and opposing said guide cylinder and including rest and pattern-yarn feed cams in combination, at least one guide piece received in each of said vertical slots in the guide cylinder for movement upwardly and downwardly therein as said rotary cylinder rotates and having a guide slot at the lower end, said guide piece having a notch for engaging said cam member, at least one twisted piece having an upper twisted portion and an integral threaded rod extending downwardly from said twisted upper portion for rotation as said guide piece moves upwardly and downwardly; at least one guide arm secured to the lower end of said threaded rod for rotation therewith and having a pattern-yarn guide hole whereby a pattern-yarn is guided through said guide hole in the guide arm into one or more selected knitting needles so as to form a pattern on a ground weave being formed and said guide piece having a substantially L-shape including a vertical upper portion provided at one side edge with said cam engaging notch and a lower horizontal portion extending at right angles to the upper portion and provided with a guide slot and said guide arm further has a slot between the opposite ends thereof so that the radial position of the guide piece assembly with respect to said guide cylinder can be adjusted.

2. The pattern-yarn feed device in a knitting machine as set forth in claim 1, in which each of said vertical slots in the guide cylinder receives two guide pieces, two twisted piece and threaded rod units and two guide arms positioned in different heights.

3. The pattern-yarn feed device in a knitting machine as set forth in claim 1, in which two cam members each having rest and pattern-yarn feed cams are disposed in a vertically-spaced relationship in each of said vertical slots in the guide cylinder surrounding and opposing said guide cylinder, two guide pieces having notches in different heights for engaging said cam members, respectively, two twisted piece-threaded rod units guided in said guide pieces and two guide arms secured to the lower ends of said threaded rods whereby when said guide pieces are moved upwardly and downwardly, the guide pieces rotate said guide arms through said twisted piece-threaded rod units so as to guide a pattern yarn to and through one or more selected knitting needles.

* * * * *